US006427268B1

(12) United States Patent
Davis

(10) Patent No.: US 6,427,268 B1
(45) Date of Patent: Aug. 6, 2002

(54) UNITARY PILLOW SHAM

(76) Inventor: Dayle M. Davis, 3321 Stanley Rd., Akron, OH (US) 44333

( * ) Notice: Subject to any disclaimer, the term of this patent is extended or adjusted under 35 U.S.C. 154(b) by 0 days.

(21) Appl. No.: 09/494,021

(22) Filed: Jan. 28, 2000

(51) Int. Cl.[7] ..... A47G 9/00
(52) U.S. Cl. ..... 5/490; 5/491
(58) Field of Search ..... 5/490, 491, 494, 5/482, 485; 2/475.08

(56) References Cited

U.S. PATENT DOCUMENTS

| | | | | |
|---|---|---|---|---|
| 880,524 | A | 3/1908 | Hauphoff | 5/490 |
| 1,269,276 | A | 6/1918 | Harris | |
| 2,446,396 | A | 8/1948 | Waranch | |
| 2,759,200 | A | 8/1956 | Johnston | |
| 3,044,517 | A | 7/1962 | Levi | |
| 3,109,182 | A | 11/1963 | Doak | |
| 3,848,281 | A | 11/1974 | Mathews | |
| 3,906,559 | A | 9/1975 | Bahr | |
| 3,974,531 | A | 8/1976 | Van Pelt | |
| 4,480,346 | A | 11/1984 | Hawkin et al. | |
| 4,480,347 | A | 11/1984 | Hawkin et al. | |
| 4,646,376 | A | 3/1987 | Sulley | 5/502 |
| 5,168,590 | A | 12/1992 | O'Sullivan | 5/490 |
| 5,430,902 | A | 7/1995 | Lewis | 5/490 |

FOREIGN PATENT DOCUMENTS

| | | |
|---|---|---|
| CA | 542873 | 7/1957 |
| GB | 929846 | 4/1962 |

OTHER PUBLICATIONS

JCPenny spring&summer '99 catalog, pp. 1321 and 1322
Horchow Home Late summer 1999 catalog, pp. 15, 20, 23, 33, 34, 36, 38, 43, 44.

*Primary Examiner*—Alexander Grosz

(57) ABSTRACT

A configuration for a unitary pillow sham (10*a*) to cover individually a plurality of pillows with a corresponding plurality of individual pillow pockets secured as one collective unit comprising an elongated one-piece length of fabric folded and secured at predetermined locations to define a plurality of pillow-receiving pockets configured in a side-by-side connecting, horizontal row and further to define vertical side flanges (36*a–b*). A selvage or hem first is secured about the perimeter of the one-piece fabric length. The fabric length is then folded about itself into three sections (14), (16), and (18) with first section (14) folded about a fold line (20) upon second section (16) so that first section (14) and second section (16) are in contact with each other, third section (18) folded about a fold line (22) upon second section (16) so that third section (18) is in partial contact with second section (16) and partially overlaps and contacts first section (14). The folded section configuration is secured with stitching (28) to present a plurality of pillow pockets (38), (40), and (42) in a pillow-receiving condition, and further to present vertical side flanges (36*a–b*). The final design provides an overall smooth appearance to each individual pillow pocket which allows firm retaining of a pillow therein and a collective design that provides superior appearance, camouflage, and function to quickly and easily span from side to side the space near the head of a bed formerly occupied by a plurality of individual conventional pillow shams placed in horizontal, contiguous relation to each other within a conventional pillow sham display and further provides a design whose manufacturing process reduces labor and reduces and eliminates inside-out construction, raw seams, raw seam edges, and seam edge treatments such as trimming and serging.

12 Claims, 9 Drawing Sheets

UNITARY PILLOW SHAM

CROSS-REFERENCE TO RELATED APPLICATIONS

Not applicable.

STATEMENT REGARDING FEDERALLY SPONSORED RESEARCH AND DEVELOPMENT

Not applicable.

BACKGROUND

1. Field of Invention

This invention relates to pillow covers and, more particularly, to pillow shams.

BACKGROUND

2. Description of Prior Art

Pillow shams have long been used to cover and provide a decorative appearance to pillows and to the beds upon which they are displayed. The pillow shams are removed to make the pillows and bed available during a sleep cycle.

The conventional pillow sham in widespread use today has one of several general shapes such as rectangular, square, etc. The sham is formed from textile sheet material having opposed front and rear panels defined by seam edges, with the rear panel being provided with a transverse opening for insertion and removal of a pillow. Similar forms are shown in Canadian Patent No. 542,873, Pillow Case, issued Jul. 2, 1957, to Smith and Revesz, and Great Britain Patent No. 929,846, Pillow cases, issued Apr. 19, 1962, to Dowie and Morrow. Pillow shams are often provided with ornate openings, borders, and edges using embellishments such as ruffles, lace, roping, cording, braiding, etc., to enhance the decorative appearance. They are also constructed using materials with elastic properties to help the sham conform closely to the pillow, such as those shown in U.S. Pat. Nos. 4,480,346 and 4,480,347, Pillow Sham, to Hawkins, et al. Other designs include U.S. Pat. No. 880,524, Washable Covering for Pillows, Feather Beds, Quilts and the Like, issued Mar. 3, 1908, to E. Hauphoff, U.S. Pat. No. 1,269,276, Army and Navy Pillow Kit, issued Jun. 11, 1918, to R. Harris, U.S. Pat. No. 2,446,396, Cushion Cover, issued Aug. 3, 1948, to T. Waranch, U.S. Pat. No. 2,759,200, Pillow Case, issued Aug. 21, 1956 to H. Johnston, U.S. Pat. No. 3,044,517, Reversible Furniture Cover or Receptacle and Method for Making Same, issued Jul. 17, 1962, to D. O. Levi, U.S. Pat. No. 3,109,182, Pillow, issued Nov. 5, 1963 to G. J. Doak, U.S. Pat. No. 3,906,559, Blanket and Sheet, issued Sep. 23, 1975, to A. Bahr, U.S. Pat. No. 3,848,281, Apertured Article and Protective Cover Therefor, issued Nov. 19, 1974 to D. Mathews, U.S. Pat. No. 3,974,531, Fitted Pillow Case, issued Aug. 17, 1976, to V. Van Pelt, U.S. Pat. No. 4,646,376, Invertible Comforter, issued Mar. 3, 1987, to G. Sulley, U.S. Pat. No. 5,168,590, Therapeutic Pillow Cover Having Compartments for Receiving Hot/Cold Packs and/or Pillow Insert Supports, issued Dec. 8, 1992, to D. O'Sullivan, U.S. Pat. No. 5,430,902, Quick Seal Pillow Cover Configuration and Method, issued Jul. 11, 1995, to D. Lewis, U.S. Pat. No. 5,566,410, Pillowcase Construction, issued Oct. 22, 1996, to A. L. Schaechter, U.S. Pat. No. 5,572,753, Pillow Case Head Cover, issued Nov. 12, 1996, to P. Ruscitto, and U.S. Pat. No. 5,864,904, Bed Pillow, issued Feb. 2, 1999, to M. Rudick.

Conventional pillow shams are usually coordinated with other bedding textiles and offered for sale throughout department stores and catalogs. Some typical pillow sham designs are displayed on pages 1321 and 1322 of the JCPenney spring&summer '99 catalog and on pages 15, 20, 23, 33, 34, 36, 38, 43, and 44 of the Horchow Home Late Summer 1999 catalog. However, none of the patents or designs referenced above show the configuration of the present invention, and all of the pillow shams previously known suffer from disadvantages or previously unrecognized problems, as follows:

(a) A person commonly purchases several pillow shams of identical size and fabric design or pattern to design a conventional pillow sham display. The display occupies the space from side to side near the head of a bed. The person typically stores the empty shams on the floor of the bedroom during a sleep cycle. She fetches each sham from storage after a sleep cycle. She places each sham over a bed pillow. Then she positions it horizontal or contiguous with other shams on the bed. She repeats these steps until the display is complete. Each sham is removed and stored again to make the bed and bed pillows available for the next sleep cycle. This presents a problem because each sham covers only one individual pillow. Multiple repetitive motions must be used to prepare and remove each sham in the display. In one year, the user turns, bends, retrieves, applies, and removes each pillow sham hundreds of times. Handling individual shams also wastes time and adds to the pressures and hectic schedules that typically face today's households.

(b) There is another method a person commonly uses to assemble a conventional pillow sham display. This method somewhat addresses the problems described above. In this instance the person uses several identical pillow shams to store extra bed pillows that are not removed from the shams for sleep cycle use. Maintaining extra pillows inside the shams eliminates the steps of applying and removing the shams from each pillow. However, the pillow-filled shams still must be individually stored and then individually fetched after a sleep cycle. They still must be aligned individually upon the bed to assemble the pillow sham display. In one year, a person will turn, bend, fetch, and align individual pillow-filled shams hundreds of times. Therefore, the problems remain that the described sham covers only one pillow and repetitive motions are still used to assemble the pillow sham display.

(c) The display is also commonly used to cover up rumpled or tousled bed pillows or top sheet borders. These items typically remain visible near the head of a bed beyond the top edge of a comforter. The user props or places shams containing extra pillows in front of the rumpled bed pillows or top sheet borders. However, another problem develops. A gap or space forms between the placement of one sham to another in the pillow sham display. The gap allows underlying surfaces to show through. This means the rumpled bedding or bed pillows may be visible at each gap. As a result, the person typically adjusts the position of each pillow sham several times this way and that way in an attempt to reduce the view at each gap. She also typically adds other decorative pillows to the display to help camouflage the view at each gap. This practice costs money and also takes up more time and energy.

(d) Still another problem develops when the described sham is positioned in a pillow sham display. The pillow sham typically slouches and shifts, and it jostles other shams. As a result, a person typically repositions each sham several times to achieve the desired display. These steps take up yet more time and energy.

(e) A disadvantage of the described pillow sham is that its manufacturing process requires extra labor and produces waste or scrap. Initially, labor is used to construct the sham in an inside out configuration to secure together raw seam edges. Labor is used to trim the seam edges which reduces bulk and produces waste. Labor is used to treat the seam edges with techniques such as serging to reduce seam edge raveling. Finally, labor is used to turn the sham right side out.

(f) Each of the described pillow shams is individually packaged for shipment. This method is wasteful and inefficient because several pillow shams of identical size and fabric design are typically purchased for use in the same pillow sham display.

SUMMARY

In accordance with the present invention, a unitary pillow sham comprising an elongated length of fabric secured to define a plurality of contiguous horizontal pillow-accepting pockets and further to define vertical side flanges.

OBJECTS AND ADVANTAGES

Accordingly, besides the objects and advantages of conventional pillow shams described in my above patent, several objects and advantages of the present invention are:

(a) to provide a pillow sham that will retain the desirable features of conventional pillow shams and will provide superior function, new and improved ease of use, and save time;

(b) to provide a pillow sham that will eliminate repetitive motions common to the method of assembling a conventional pillow sham display and which are detrimental to the user;

(c) to provide a pillow sham that will eliminate the view of underlying surfaces such as rumpled bedding that is visible at the gap that exists between each contiguous horizontal placement of one sham to another within a conventional pillow sham display;

(d) to provide a pillow sham that will eliminate slouching, shifting, and jostling motions that typically result when a pillow sham is placed contiguous to other shams in a conventional pillow sham display;

(e) to provide a pillow sham whose production will reduce labor and eliminate waste;

(f) to provide a pillow sham whose production will reduce and eliminate inside out construction;

(g) to provide a pillow sham whose production will reduce and eliminate the quantity of raw seams and raw seam edges;

(h) to provide a pillow sham whose production will reduce and eliminate techniques such as seam trimming and serging typically used to reduce seam edge raveling;

(i) to provide a pillow sham whose shipment will reduce waste in the packaging process.

Still further objects and advantages will become apparent from a consideration of the drawings and ensuing description.

DRAWING FIGURES

Closely related drawing figures have the same number but different alphabet suffixes.

Figure 3A:
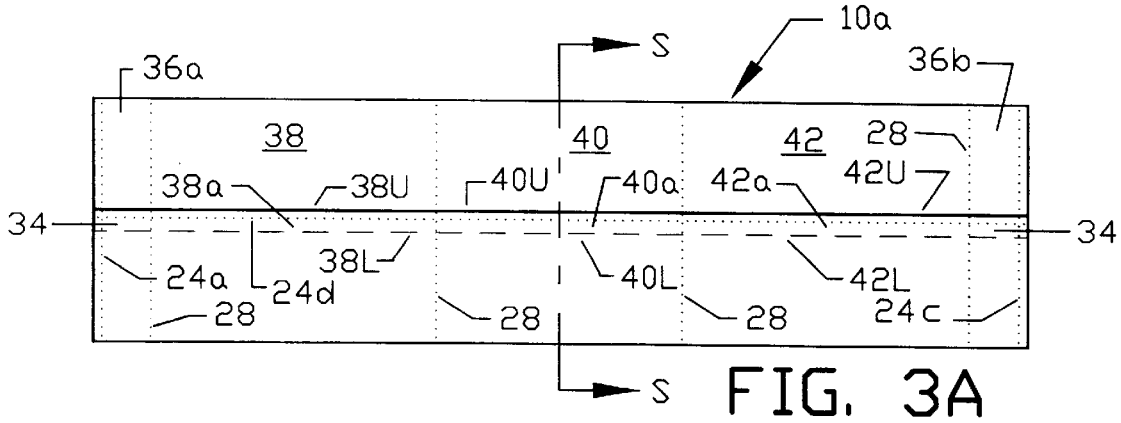
FIG. 3A shows the rear view of the one-piece layer of FIG. 2 after it is folded and secured.
Figure 3B:
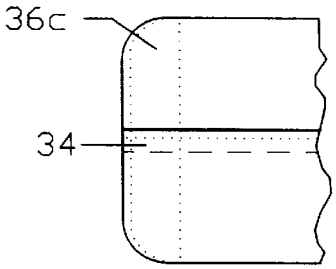
Figure 3C:
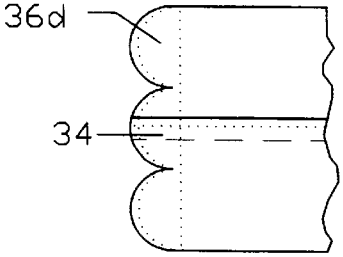
Figure 3D:
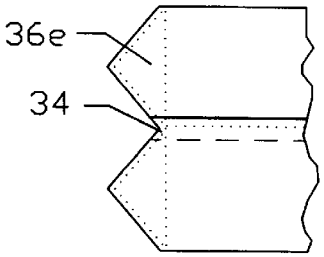

FIGS. 3B–D show various flange embodiments of the unitary pillow sham of FIG. 3A.

Figure 3E:
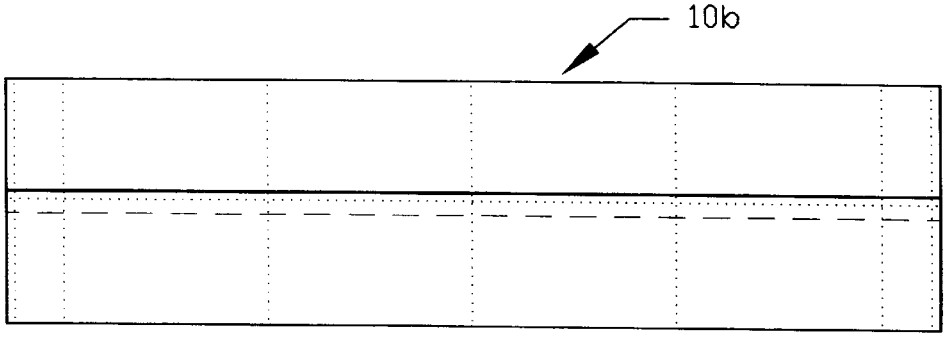
Figure 3F:
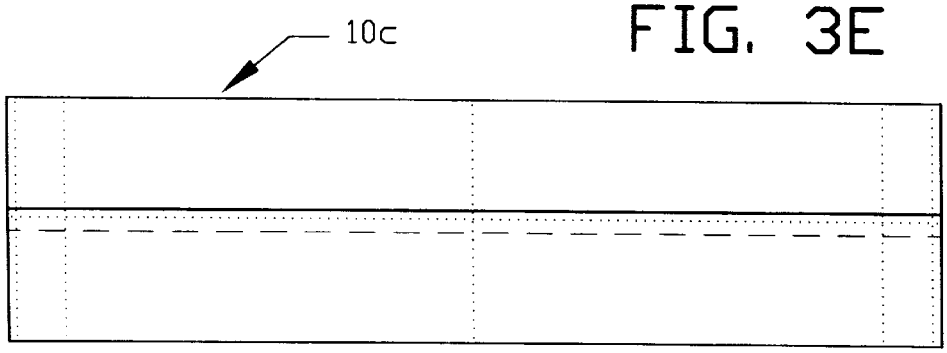

FIGS. 3E–F are alternative embodiments of the view of FIG. 3A.

Figure 4:
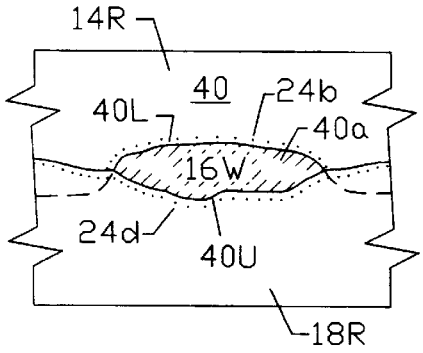

FIG. 4 is an exaggerated view of a pillow pocket to show pocket opening and pocket edges.

Figure 5:
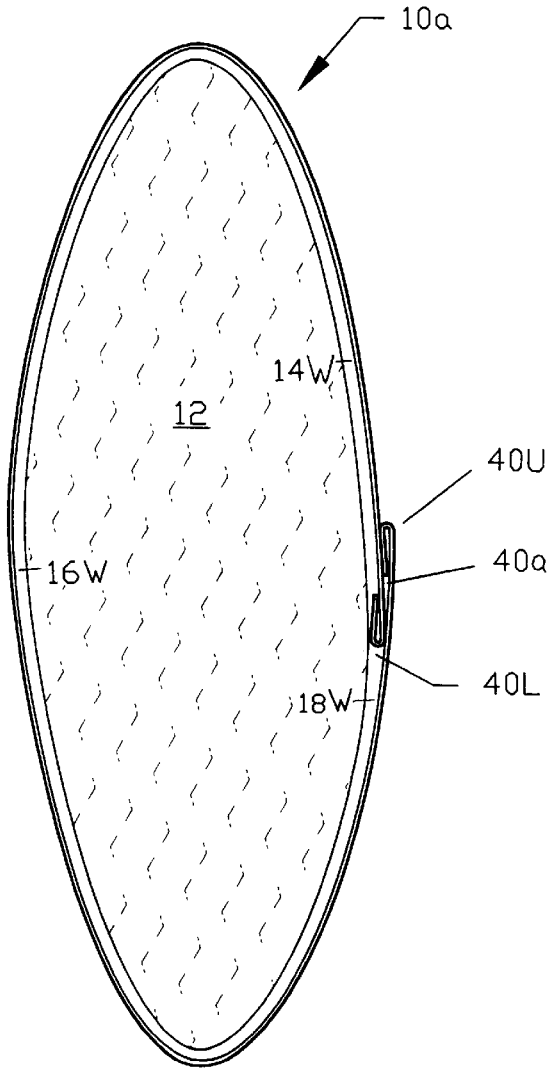

FIG. 5 is a sectional view taken substantially along line S—S of FIG. 3A, with pillow inserted.

Figure 1:
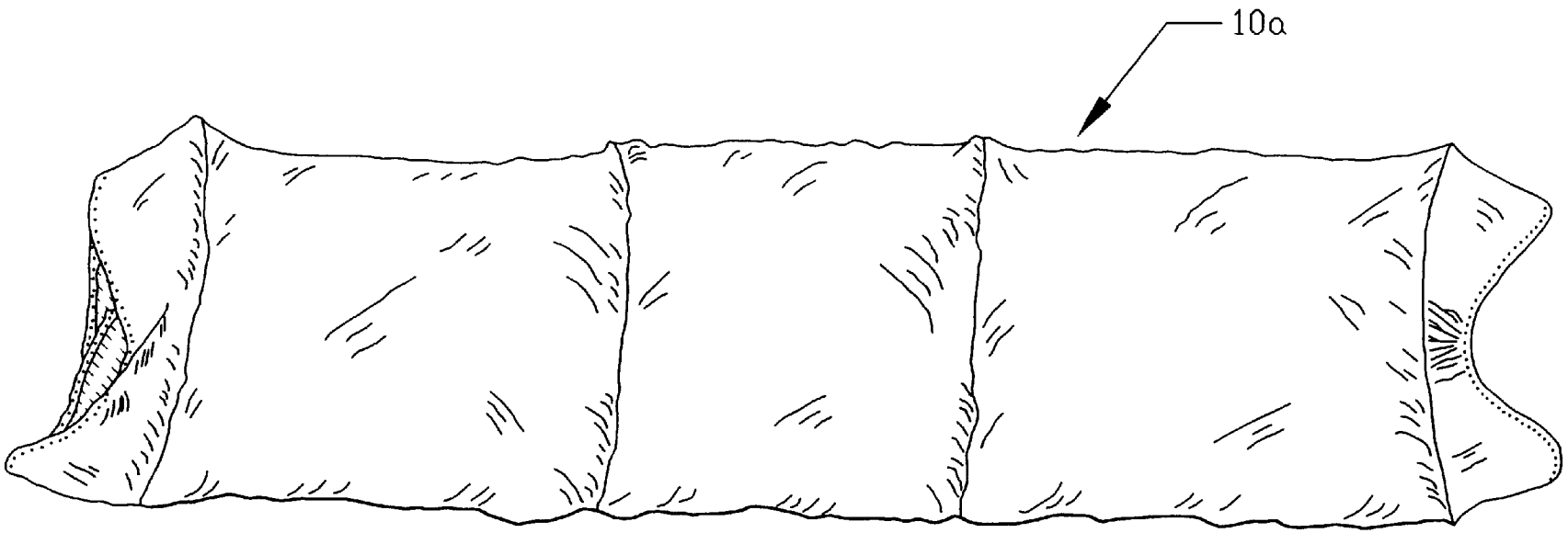
FIG. 1 is a front perspective view of a unitary pillow sham containing pillows.
Figure 6:
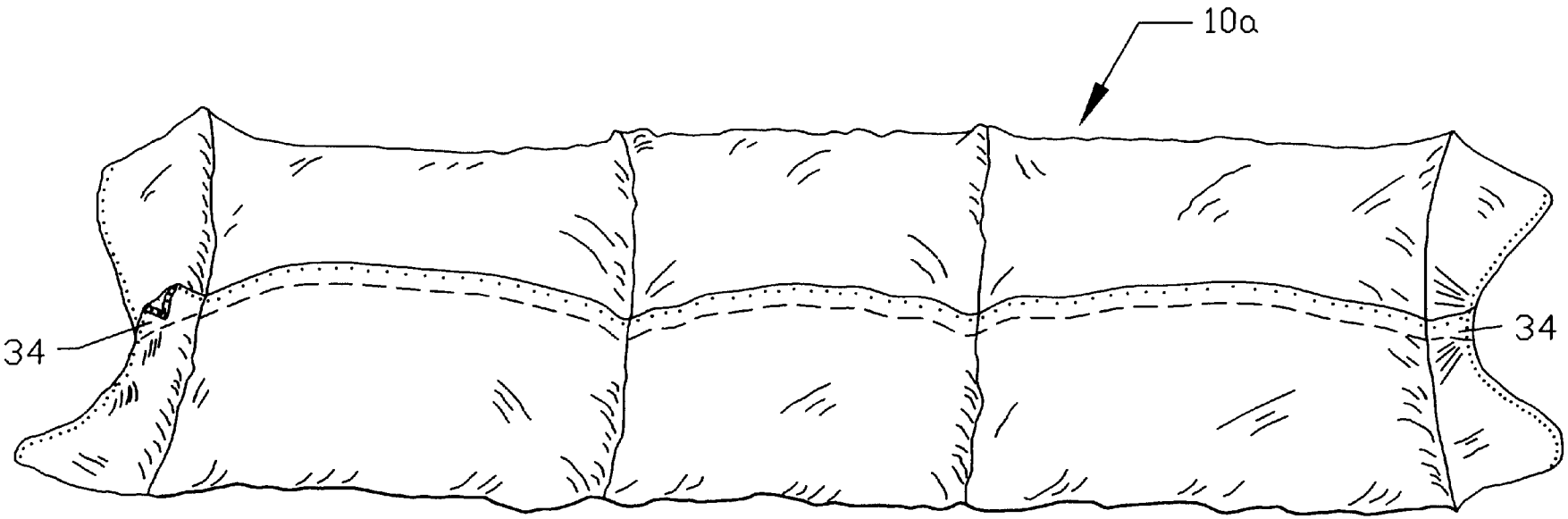

FIG. 6 is a rear perspective view of the unitary pillow sham of FIG. 1.

Figure 2A:
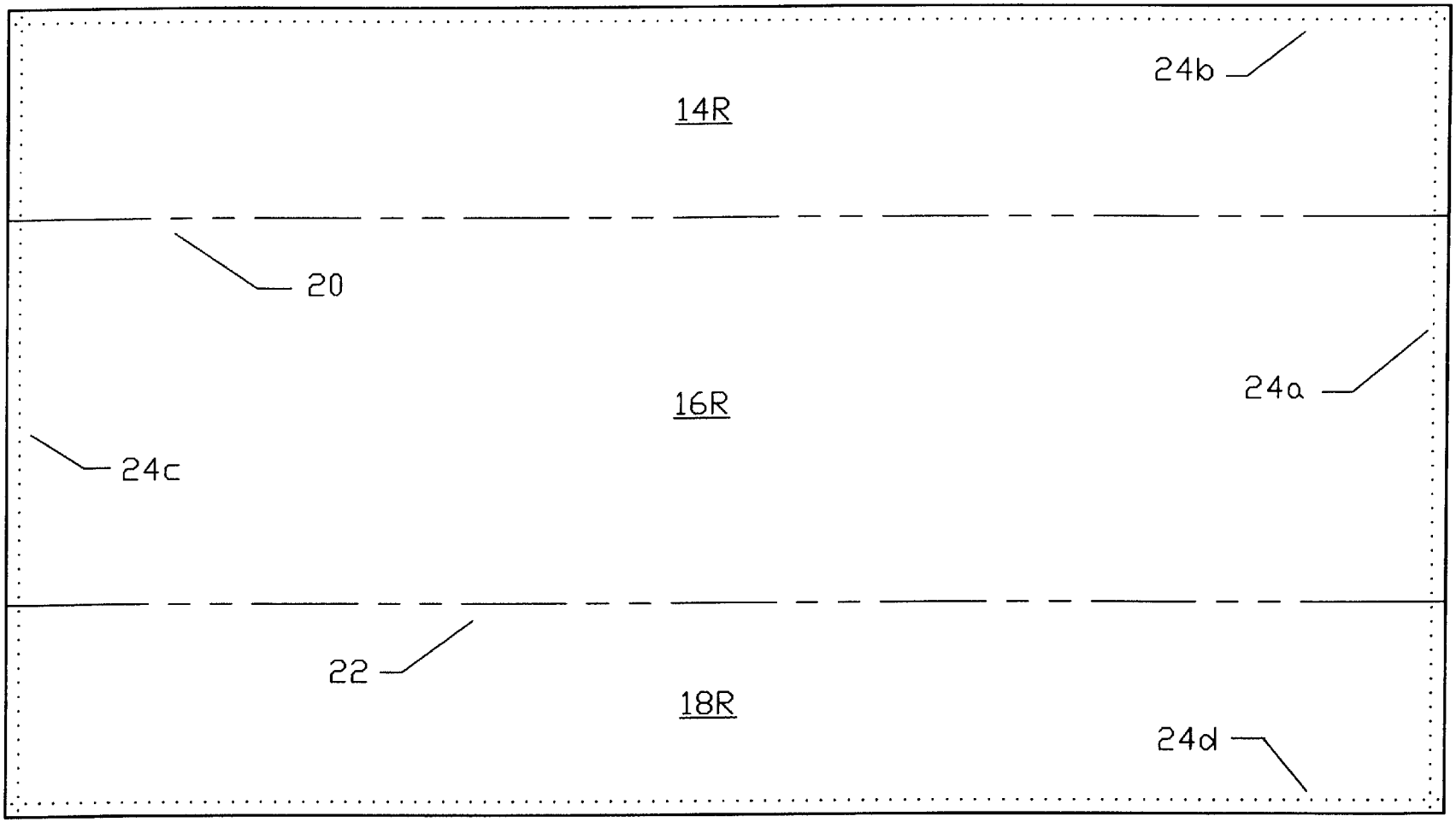
FIG. 2A is a top plan view of a one-piece layer of fabric used to make a unitary pillow sham.
Figure 7:
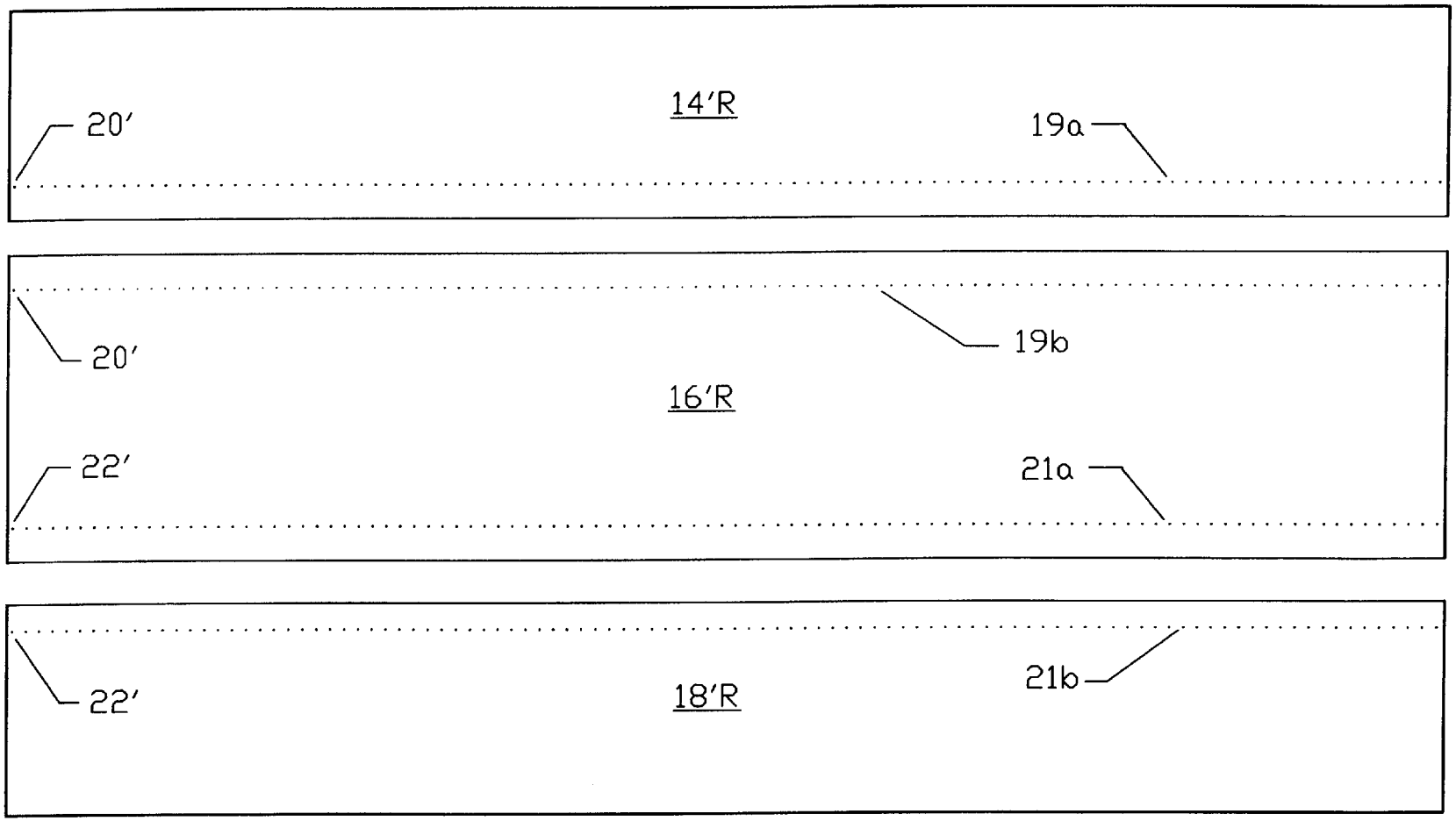

FIG. 7 is a view of individual sections to be secured to achieve the basic layout of FIG. 2A.

Figure 8A:
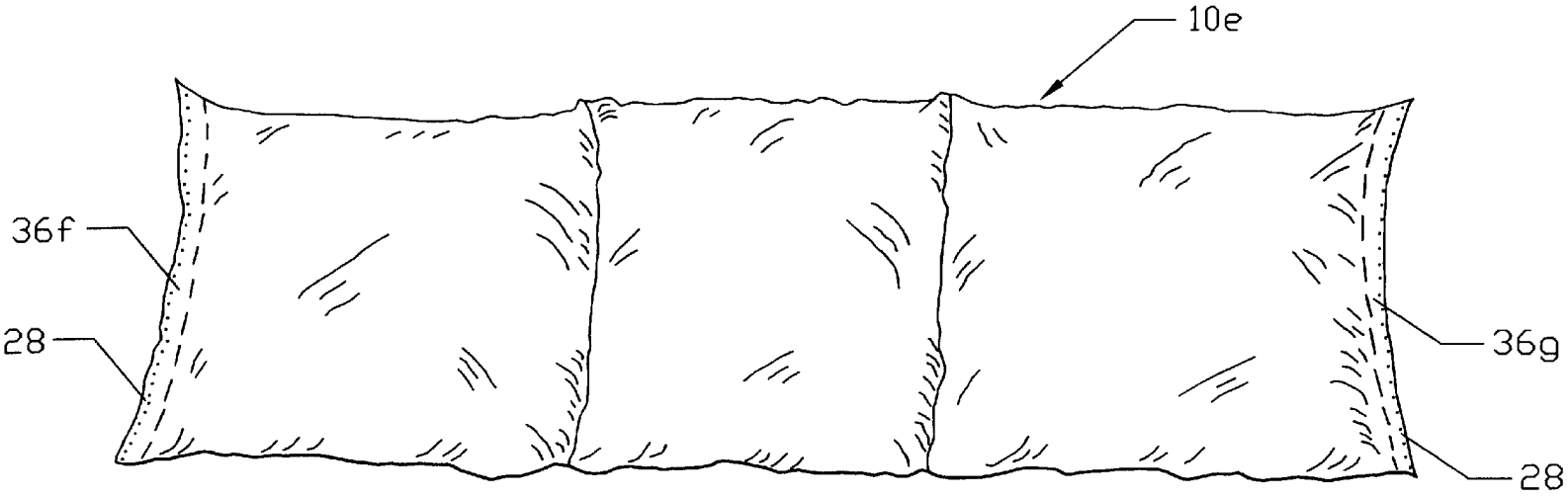

FIG. 8A is an alternative embodiment of FIG. 1 with flanges reduced and inverted.

Figure 8C:
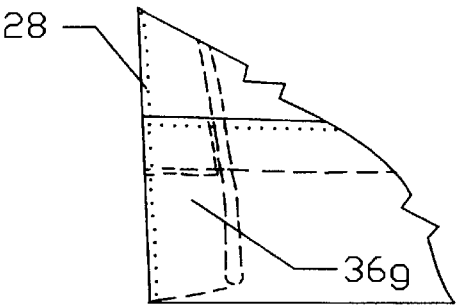
Figure 8B:
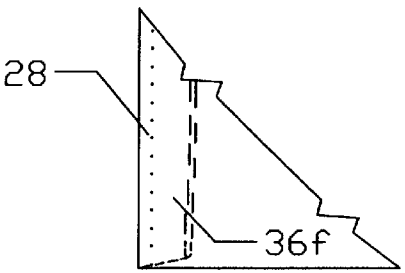

FIG. 8B is an exaggerated front view portion of FIG. 8A.

FIG. 8C is an exaggerated rear view portion of FIG. 8A.

Figure 9A:
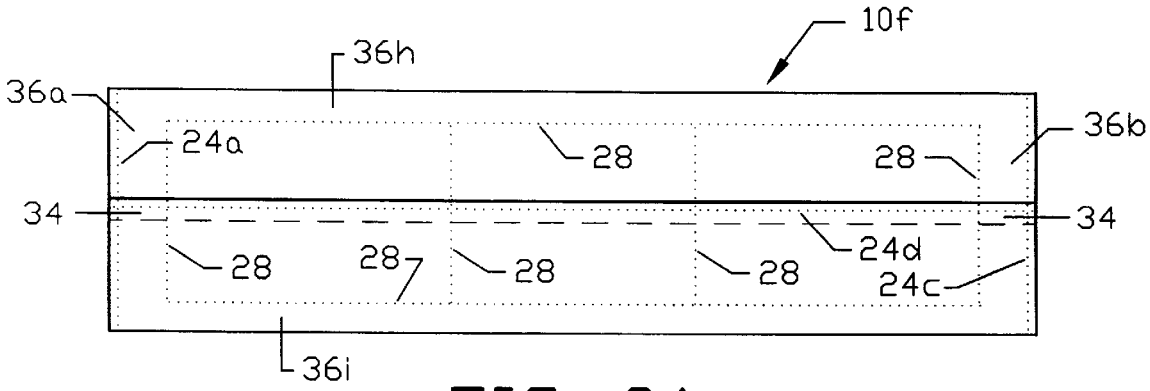

FIG. 9A is an alternative embodiment of FIG. 3A.

Figure 9B:
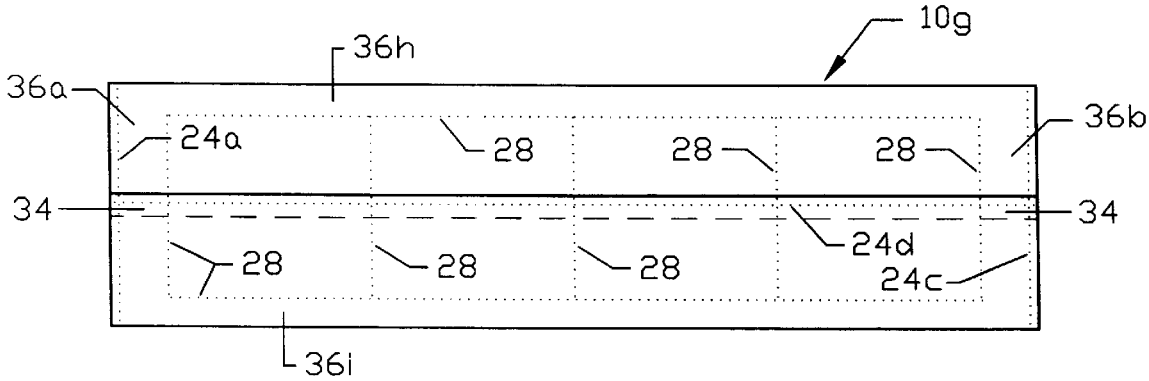

FIG. 9B in an alternative embodiment of FIG. 9A.

Figure 9C:
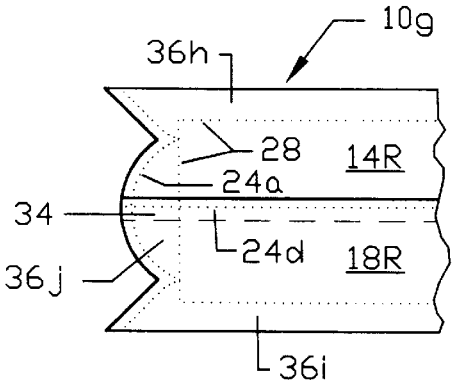

FIG. 9C presents an alternative vertical flange embodiment of FIG. 9A.

Figure 9D:
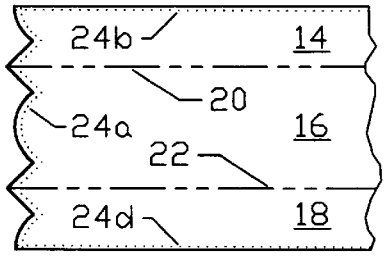

FIG. 9D is an alternative embodiment of FIG. 2A that can be folded and subsequently secured to achieve the vertical flange design of FIG. 9C.

List of Reference Numerals

| | |
|---|---|
| S | sectional view |
| 10a–c | unitary pillow sham |
| 10e–g | unitary pillow sham |
| 12 | pillow |
| 14 | first section |
| 16 | second section |
| 18 | third section |
| 19a–b | first fold-line seam |
| 20 | first fold line |
| 21a–b | second fold-line seam |
| 22 | second fold line |
| 24a–d | hems |
| 26 | trim |
| 28 | stitching |
| 34 | flange overlaps |
| 36a–j | flanges |
| 38 | first pillow pocket |
| 38a | first pocket opening |
| 38U | first upper edge |
| 38L | first lower edge |
| 40 | second pillow pocket |
| 40a | second pocket opening |
| 40U | second upper edge |
| 40L | second lower edge |
| 42 | third pillow pocket |
| 42a | third pocket opening |
| 42U | third upper edge |
| 42L | third lower edge |

DESCRIPTION

FIGS. 1, 2A, 3A, 4, 5, and 6

Preferred Embodiment

A preferred embodiment of the unitary pillow sham of the present invention is illustrated in FIG. 1 (front perspective view) and FIG. 6 (rear perspective view). In the drawings, a unitary pillow sham 10*a* is adapted to enclose in secure fashion three bed pillows collectively represented as pillow 12, all of substantially equal height and two of substantially equal width with one pillow being an approximate measure of lesser width than the other pillows, each pillow inserted separately into a first pillow pocket 38, a second pillow pocket 40, and a third pillow pocket 42 through respective first, second, and third pocket openings 38*a*, 40*a*, and 42*a* and, at the same time, present flanges 36*a–b* and a flange overlap 34 at either vertical side end of the sham. For a better understanding of the construction of the unitary pillow sham, the manner in which it is constructed and secured will initially be described. FIG. 2 shows an elongated length of one-piece fabric in a size suitable to present vertical flanges and to contain individually the desired plurality of pillows. In the preferred embodiment, the one-piece fabric is a single piece of cotton textile. However, the fabric can consist of any other material that can be conformed to pillow sham use such as taffeta, nylon, satin, flannel, damask, rayon, silk, leather, tapestry, brocade, plasticized materials, elasticized materials, quilted fabric layers, etc. The surface of the fabric shown in FIG. 2 will be taken to be the right side and the other the wrong side which becomes important where printed, textured, quilted or other patterned types of fabric are utilized. The width of the fabric in FIG. 2 is divided into first, second and third sections 14, 16, and 18 defined by respective fold lines 20 and 22. The sections will accordingly have respective right sides 14R, 16R, and 18R as well as respective wrong sides 14W, 16W, and 18W. Selvage or small hems 24*a–d* will be turned and secured to the wrong side of the perimeter of the fabric. The length of the fabric will be turned or folded so that the first and third sections each approximate a measure of contact with the second section as well as to approximate a measure of contact between the first and third sections. The folded configuration will then be apportioned to define the desired location of each pillow pocket in proportion to its desired size and to define flanges at either vertical end. Stitching 28, sewing, or other means of joining will secure the pillow pockets and the flanges.

In order to construct the unitary pillow sham, section 14 is folded about fold line 20 upon section 16 so that sides 14W and 16W are in contact with each other. Thereafter section 18 is folded about line 22 upon section 16 so that side 18W is in partial contact with side 16W and partially overlaps and contacts side 14R. In FIG. 3A the folded section configuration is secured along stitching 28 to define pillow pockets, pocket openings, flanges, and flange overlaps. Flange overlaps will now present themselves at 34. Flanges will now present themselves at 36*a–b*. Pockets will now present themselves at 38, 40, and 42 in a pillow-receiving condition with pocket openings at 38*a*, 40*a*, and 42*a*, respectively, as well as upper edges at 38U, 40U, and 42U and lower edges at 38L, 40L, and 42L. A cross-sectional view S—S of FIG. 3A is further defined in FIG. 5.

The exaggerated view of FIG. 4 demonstrates the relationship of sections 14R, 16W, and 18R at the junction of pocket opening 40*a* with upper edge 40U and lower edge 40L. This view (FIG. 4) is also representative of the relationship of pocket openings 38*a* and 42*a* to upper and lower edges 38U, 38L, 42U, and 42L, respectively.

FIG. 5 delineates cross-sectional view S—S of pocket 40 with pillow 12 inserted which defines opening 40*a* and also defines the relationship of upper edge 40U to lower edge 40L. The view of FIG. 5 is also representative of pockets 38 and 42, pocket openings 38*a* and 42*a*, and the relationships of upper and lower edges 38U, 38L,42U, and 42L, respectively.

FIG. 7—Additional Embodiments

Additional embodiment is shown in FIG. 7. Different fabric combinations can be incorporated into individual sections 14', 16', and 18' delineated in FIG. 7. Section 16' utilizes one fabric while sections 14' and 18' utilizes another fabric. Sides 14'R and 16'R are positioned together so that an edge portion of 14'R overlaps an adjacent edge portion of 16'R and are secured at first fold-line seams 19*a* and 19*b* to present first fold line 20'. Sides 16'R and 18'R are positioned together so that an edge portion of 16'R overlaps an adjacent edge portion of 18'R and are secured at second fold-line seams 21*a* and 21*b* to present second fold line 22'. The basic outline of the section shown in FIG. 2A is now presented.

FIGS. 2B, 3B–F, 8A–C, 9A–D—Alternative Embodiments

Figure 2B:
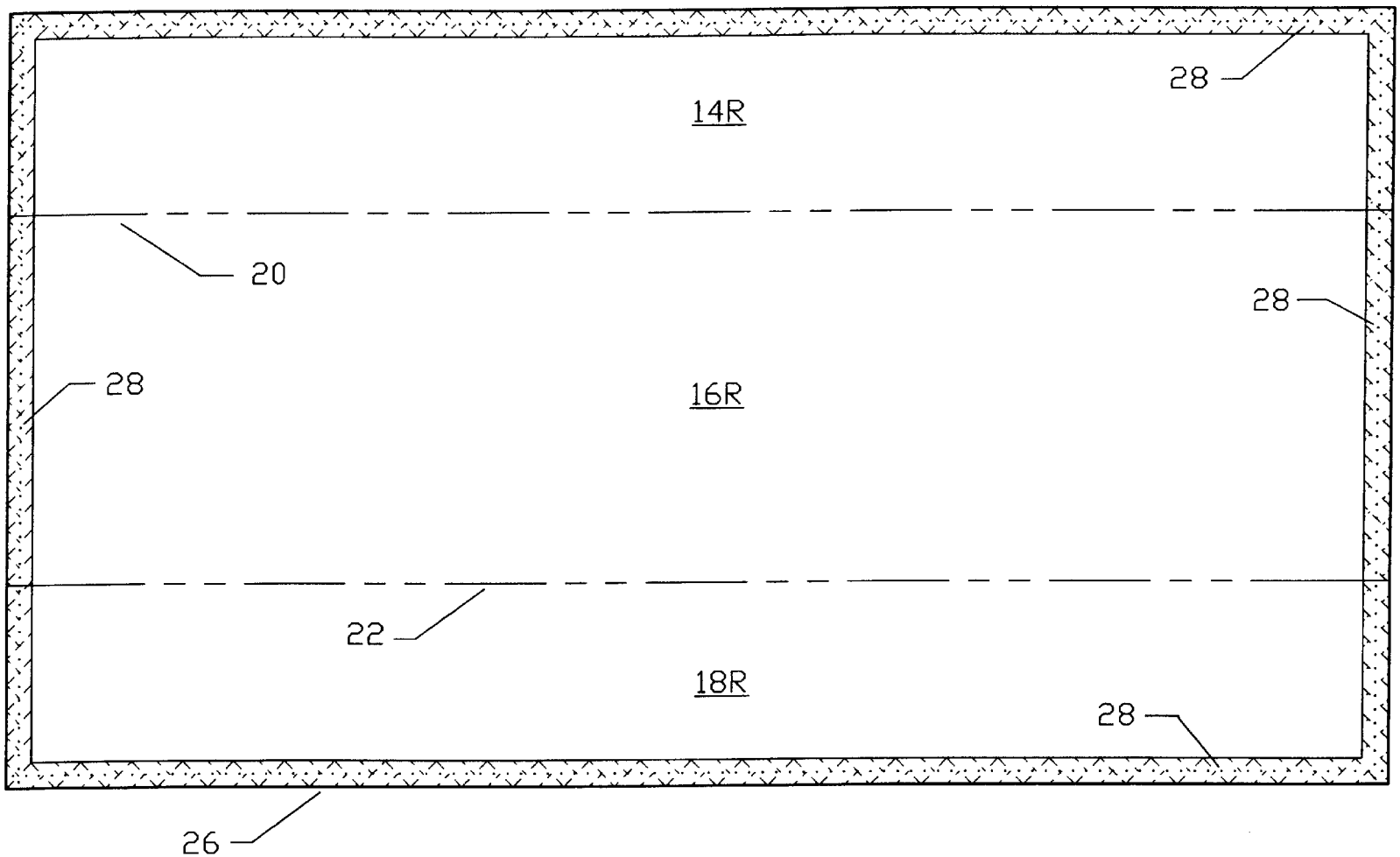
FIG. 2B shows the unhemmed view of FIG. 2A bound at its perimeter with decorative trim.

There are various possibilities with regard to the relative disposition of flanges, stitching, hems, and pillow pockets. In FIG. 2B the elongated fabric section is unhemmed and bound about its perimeter with a decorative trim. FIGS. 3B, 3C, 3D, and 9C depict a variety of decorative flanges at 36*c*, 36*d*, 36*e*, and 36*j*. FIGS. 3E–F show variation in plurality and sizing of pillow pocket configurations of sham 10*a*. In FIG. 8A flanges 36*f–g* are reduced in size, inverted to the inside of the sham, abutted, and secured with stitching 28 applied to the outside vertical edge surfaces of sham 10*e*. In FIG. 8B an exaggerated front view corner of sham 10*e* shows the inverted position of flange 36f as secured by stitching 28. FIG. 8C exaggerates a rear view corner of sham 10*e* to demonstrate the position of flange 36*g*. In FIG. 9A, flanges are defined along the entire perimeter of sham 10*f* at 36*a–b* and 36*h–i*. FIG. 9B shows variation in plurality of pillow pocket configurations of sham 10*f*. FIG. 9D demonstrates alternative embodiment of FIG. 2A that is subsequently folded and secured to achieve flange 36*j* of FIG. 9C.

Advantages

From the description above, a number of advantages of my unitary pillow sham become evident:

(a) It produces new, unexpected, and superior results that supersede the combined functions of several identical conventional pillow shams placed within a pillow sham display.

(b) It provides for ease of use which saves time. A person can gently toss and spread the pillow-filled unitary pillow sham with one uniform motion. It spans the space near the head of a bed immediately to create a pleasing pillow sham display with minimal effort. The unitary pillow sham remains stable upon the bed until it is removed. No adjustments are required. The vertical side flanges automatically drape at either side end of the unitary pillow sham in a decorative manner that enhances the display as well as camouflages the view of bedding located just beneath the flanges along the edges of the bed.

(c) Its function reduces repetitive movements that are detrimental to the user of a conventional pillow sham display. The display is created in one step and can be removed from the bed in one step.

(d) Its one-piece construction eliminates all gaps and the corresponding problem of rumpled bedding or pillows showing through. This saves money because a person can eliminate the purchase of additional decorative pillows formerly required to help camouflage the gaps in a conventional pillow sham display.

(e) It eliminates the slouching, shifting and jostling motions common to assembling a conventional pillow sham display. The unitary pillow sham supports itself and does not require adjustment.

(f) It eliminates inside-out construction in the manufacturing process which reduces labor costs.

(g) It reduces and eliminates raw seams, raw seam edges, seam trimming, and seam edge treatment in the manufacturing process and therefore reduces labor, costs and material waste.

(h) it allows manufacture in a variety of sizes to accommodate any size bed;

(i) It reduces package and shipping waste because only one unitary pillow sham is needed to supersede the combined functions of several identical conventional pillow shams.

Operation

In applying unitary pillow sham 10*a* of this invention, the following procedure is proposed:

1. Position unitary pillow sham 10*a* lengthwise with first pillow pocket 38 having first pocket opening 38*a* toward the individual applying the sham.
2. Position the pillow reserved for the pillow pocket lengthwise in front of this opening.
3. Separate first upper edge 38U and first lower edge 38L at center of the pocket with both hands. Grasp first upper edge 38U with left hand and with right hand grasp right lower corner of pillow and guide it through first pocket opening 38*a* into right lower corner of first pillow pocket 38. Move right hand to grasp left lower corner of pillow and guide it through the pocket opening into left lower corner of the pocket.
4. With left hand reach behind the portion of pillow that remains outside the pocket to grasp first lower edge 38L with left hand. With right hand guide left upper corner of pillow through the pocket opening into matching corner of the pocket. Move right hand to grasp right upper corner of pillow and guide it through the pocket opening into matching corner of the pocket.
5. Insert both hands into the pocket and adjust pillow to achieve a uniform exterior surface of the front and rear pocket. Remove hands and smooth first upper edge 38U into position over corresponding first lower edge 38L. The pillow will remain stable within the pocket until removed.
6. To insert individual pillows into second and third pillow pockets 40 and 42, repeat steps 1 through 5 above with corresponding second and third pocket openings 40*a* and 42*a*, and second and third upper and lower edges 40U, 40L, 42U, and 42L, respectively.
7. Position the unitary pillow sham that now contains pillows in all three pockets lengthwise so that the pillow pocket openings face away from the body. With the left hand grasp an upper portion of the outside of the pillow pocket closest to that hand. Grasp an upper portion of the outside of the pillow pocket closest to the right hand. Maintain the grasp with both hands. Move close to and face the side of the bed earmarked to receive the sham with the head of the bed near to the body's left side. Lean slightly forward while turning the torso slightly to the left and extending the right arm wide. Gently toss and release the unitary pillow sham from the hands across and onto the bed into a position that spans from side to side the space near the head of the bed typically reserved for a pillow sham display. The unitary pillow sham will remain stable in that position until removed.

In removing unitary pillow sham 10*a* the following procedure is proposed:

1. Grasp a portion of the sham with either hand and pull the sham from the bed. Position the sham so that first pillow pocket 38 and first pocket opening 38*a* face and are horizontal to and nearest the body.
2. Separate first upper and lower edges 38U and 38L at center of the pocket with both hands. Grasp first upper edge 38U with left hand. Slide right hand into pocket opening to grasp right lower corner of pillow and guide it through the pocket opening and out of the pocket. Move right hand to grasp left lower corner of pillow and guide it through the pocket opening and out of the pocket.
3. Grasp first lower edge 38L with left hand. Slide right hand into pocket opening to grasp left upper corner of pillow and guide it through the pocket opening and out of the pocket. Slide right hand into pocket opening to grasp right upper corner of pillow and guide it through the pocket opening and out of the pocket.
4. To remove each pillow from second and third pillow pockets 40 and 42 repeat removal steps 1 through 3 above with corresponding second and third pocket openings 40*a* and 42*a* and second and third upper and lower edges 40U, 40L, 42U, and 42L, respectively.

CONCLUSION, RAMIFICATIONS AND SCOPE

Thus the reader will see that the unitary pillow sham of my invention can be used to quickly and easily span and better camouflage the expanse near the head of a bed formerly occupied by several conventional pillow shams. It retains the desirable features of conventional pillow shams while it contributes superior results. It is conveniently and comfortably used by persons of almost any age with minimal fussing. Furthermore, the unitary pillow sham has the additional advantages in that it reduces time spent making the bed;

it eliminates repetitive motions that are typical to the method of creating a conventional pillow sham display and that are detrimental to the user;

it produces new, unexpected, and superior results that supersede the combined functions of several conventional pillow shams in a pillow sham display;

it eliminates the view of underlying materials such as rumpled bedding and bed pillows visible at the gaps and spaces that exist between each contiguous placement of one individual conventional sham to another in a conventional pillow sham display;

it eliminates slouching, shifting, and jostling movements that typically result when individual pillow shams are placed in a conventional pillow sham display;

its manufacture eliminates inside-out construction which reduces labor and costs;

its manufacture reduces and eliminates raw seams and raw seam edges, seam trimming and seam edge treatment such as serging which reduces costs, labor, and waste;

it allows manufacture in a variety of sizes to accommodate any sized bed;

it reduces package and shipping waste because one unitary pillow sham will supersede the combined functions of several identical conventional pillow shams.

It will be appreciated that modifications may be made without departing from the spirit of the invention. Although the drawings and description above contain many specificities, these should not be construed as limiting the scope of the invention but as merely illustrating some of the presently preferred embodiments and uses of a unitary pillow sham. It will be apparent that many changes may be made in the form, arrangement, and positioning of the various elements of the combination. For example, pocket edges can vary in shape; pocket openings can be secured using different methods such as hook and loop, buttons, zippers, tassels, etc.; the sham can be adapted for use on other surfaces used for reclining or sitting; the sham pockets can be sized to accommodate a combination of pillow sizes including standard, queen, or king which adds interest and variety to the design; the sham pockets can be constructed of a size to accommodate the pillow style and size commonly known as European or other styles and sizes that are larger or smaller than standard, queen, or king; the sham can be produced in a variety of dimensions that span from side to side any size mattress including single, double, queen, king mattresses, etc;. various materials and fibrous fillers suitable for pillow use can be used to fill each pillow pocket; the sham can be embellished with ornate borders, ruffles, ribbons, buttons, braiding, etc.; the hems of inverted side flanges can be omitted; the length of fabric that is subsequently folded and secured to produce the sham can first be constructed of a patchwork of fabric pieces; various fabric pieces can be secured together that will depict a decorative scene or design that is incorporated into the overall design of a pillow pocket or pockets; various fabric pieces can be secured together to produce a patchwork effect, scene, design, etc. for a flange or flanges.

Further, while still other embodiments are possible, it is advantageous to use a single piece of fabric, which my method allows. Cutting is minimized, fabric requirements are reduced, and labor and equipment are unnecessary to join multiple pieces together.

All of these and other modifications are within the true spirit and scope of my invention. Thus the scope of my invention should be determined by the appended claims and their legal equivalents, rather than by the examples given.

I claim:

1. A pillow sham comprising a generally rectangular piece of fabric (FIGS. 2A, 2B) having a length and width, the width of the fabric divided along fold lines (elements 20, 22) thereby creating first section, second section, and third section (elements 14, 16, 18) wherein said first section (element 14) and said third section (element 18) are folded upon said second section (element 16) so that said first section and said third section each approximate a measure of contact with said second section as well as to approximate a measure of contact between said first section and said third section (FIG. 5) so as to present a folded configuration of said length of fabric, said folded configuration then apportioned and secured (element 28) at predetermined locations to present as a collective unit a plurality of individual pockets configured in a side by side connecting row (elements 38, 40, 42, also FIGS. 1, 6) with respective pocket openings (elements 38*a*, 40*a*, 42*a*, also FIG. 4 ) and further to present flanges (element 36) at either side end of the folded and secured configuration.

2. The pillow sham of claim 1, comprising:

a length of fabric (FIG. 2A), said length of fabric divided into first section (element 14), second section (element 16), and third section (element 18), the sections defined by respective fold lines (FIG. 2A, elements 20 and 22), said length of fabric folded about said fold lines wherein said first section and said third section each approximate a measure of contact with said second section as well as to approximate a measure of contact between said first section and said third section, (FIGS. 3A, 4, 5), and said length of fabric as presented in a folded configuration thereafter apportioned and secured at predetermined locations to define a connecting row of a plurality of side by side pillow pockets (elements 38, 40, 42), further to define respective pillow pocket openings at the measure of contact between said first section and said third section (elements 38*a*, 40*a*, 42*a*), and further to define flanges (element 34) at either vertical end of said pillow sham, whereby said pillow sham configuration presents a pillow sham in a pillow-receiving condition that eliminates raw seams, seam edges, and seam edge treatments such as trimming and serging.

3. The pillow sham of claim 2 wherein said first section, said second section and said third section comprise any combination of materials that can be conformed to pillow sham use (FIG. 7).

4. The pillow sham of claim 2 wherein said pillow pockets comprise equally apportioned individual widths (FIGS. 3E, 3F).

5. The pillow sham of claim 2 wherein said pillow pockets vary in individual widths (FIG. 3A).

6. The pillow sham of claim 2 wherein decorative stitching is defined along the perimeter of said pillow sham (FIGS. 9A, 9B).

7. The pillow sham of claim 2 wherein said flanges are inverted (FIGS. 8A, 8B, 8C).

8. The pillow sham of claim 7 wherein the inverted flanges present abutted folds (FIGS. 8A, 8B, 8C).

9. The pillow sham of claim 8 wherein said abutted folds are secured together with stitching (FIGS. 8A, 8B, 8C).

10. The pillow sham of claim 2 wherein said fabric length is unhemmed (FIG. 2B).

11. The pillow sham of claim 10 wherein said fabric length is bound about its perimeter with an object from the group consisting of trims and ribbons (FIG. 2B, element 26).

12. An improvement in a pillow sham of the type comprising an encasing body for enveloping a pillow and an opening to accept the pillow wherein a method to configure said pillow sham comprises:

providing a length of fabric (FIG. 2A), the surface of said length of fabric taken to be the right side and the other the wrong side, securing a selvage or hem edge about the perimeter of said length of fabric (FIG. 2A, elements 24*a* through *d*), folding said length of fabric about its width to define a configuration comprising a first section, a second section, and a third section with respective right sides (FIG. 2A, elements 14R, 16R, and 18R) as well as respective wrong sides (FIG. 2A, elements 14W, 16W, and 18W) wherein the wrong sides of said first section (element 14W) and said third section (element 18W) each approximate a measure of contact with the wrong side of said second section (element 16W) as well as to approximate a measure of contact between said first section and said third section (FIG. 5), securing said configuration at predetermined locations (FIG. 3A, element 28), which will define a connecting row of a plurality of side by side pillow pockets (FIG. 3A, elements 38, 40, 42), define pocket openings (FIG. 3A, elements 38*a*, 40*a*, 42*a*), define flanges (FIG. 3A, elements 36*a*, 36*b*), whereby said method eliminates inside out construction to present a pillow sham in a pillow-receiving condition and further reduces and eliminates raw seams, seam edges, and seam edge treatments such as trimming and serging.

* * * * *